United States Patent [19]

Jeninga

[11] 4,046,413

[45] Sept. 6, 1977

[54] GOLF BALL RETRIEVER

[75] Inventor: John Jeninga, Delavan, Wis.

[73] Assignee: Atlantic Products Corporation, Trenton, N.J.

[21] Appl. No.: 723,598

[22] Filed: Sept. 14, 1976

[51] Int. Cl.[2] ..... A63B 47/02

[52] U.S. Cl. ..... 294/19 A

[58] Field of Search ..... 294/19 R, 19 A, 20, 294/33, 99 R; 273/32 F, 81 R, 162 E

[56] References Cited

U.S. PATENT DOCUMENTS

| | | | |
|---|---|---|---|
| 1,749,753 | 3/1930 | Cauffield | 294/20 |
| 1,968,616 | 7/1934 | Oldham | 273/81 R |
| 2,549,257 | 4/1951 | Staunt | 294/19 A |
| 3,029,097 | 4/1962 | Ward | 294/19 A |
| 3,046,044 | 7/1962 | Christle | 294/19 A |
| 3,149,872 | 9/1964 | Ward | 294/19 A |
| 3,421,788 | 1/1969 | Smith | 294/19 A |
| 3,547,477 | 12/1970 | Young | 294/19 A |

*Primary Examiner*—Johnny D. Cherry

[57] ABSTRACT

A pair of spaced wire loops, large enough to pass a golf ball therethrough are secured to the end of a handle and define a ball holder or retainer, a pivoted gate between the loops can block either one and serve as a support for a ball that has entered the retainer. The loops are sufficiently resilient to permit forcing a golf ball between their outer ends and an extensible handle can be frictionally locked in its extended condition.

5 Claims, 8 Drawing Figures

GOLF BALL RETRIEVER

BACKGROUND OF THE INVENTION

This invention is in the field of ball retrieving devices and particularly golf ball retrievers.

Many golf ball retrievers have been proposed heretofore but all had certain shortcomings such as difficulty in engaging and retrieving a ball or difficulty in releasing the ball after being engaged and lifted by the device. Golf balls often become lodged in places that are difficult of access or in water rendering it necessary to provide some device for retrieving the ball regardless of its lie or surroundings. Patents numbered U.S. Pat. Nos. 3,046,044 and 3,029,097 each show ball retrievers having an extensible handle and a ball container with an opening through which the ball can be passed. A gate normally closes the opening but is swung inwardly when the device is placed over a golf ball and lowered thereon, then the gate drops to trap the ball in the container. To recover the ball after withdrawal from a body of water or the like it is necessary that the gate be manually opened to release the ball and in many cases the device is wet and often muddy which soils the user's hands. In addition, the patented devices permit engagement with a ball to be retrieved in only one attitude.

SUMMARY OF THE INVENTION

The present invention is a simplified but reliable ball retriever having a minimum of parts and offering the user a selection of manners in which to engage the ball to lift the same from an inaccessible lie and wherein a simple inversion of the device releases the ball without the necessity of handling the ball-engaging portions.

It is, therefore, an object of this invention to provide a ball retriever simple and economical to construct and use and reliable in operation.

DESCRIPTION OF A PREFERRED EMBODIMENT

Figure 1:
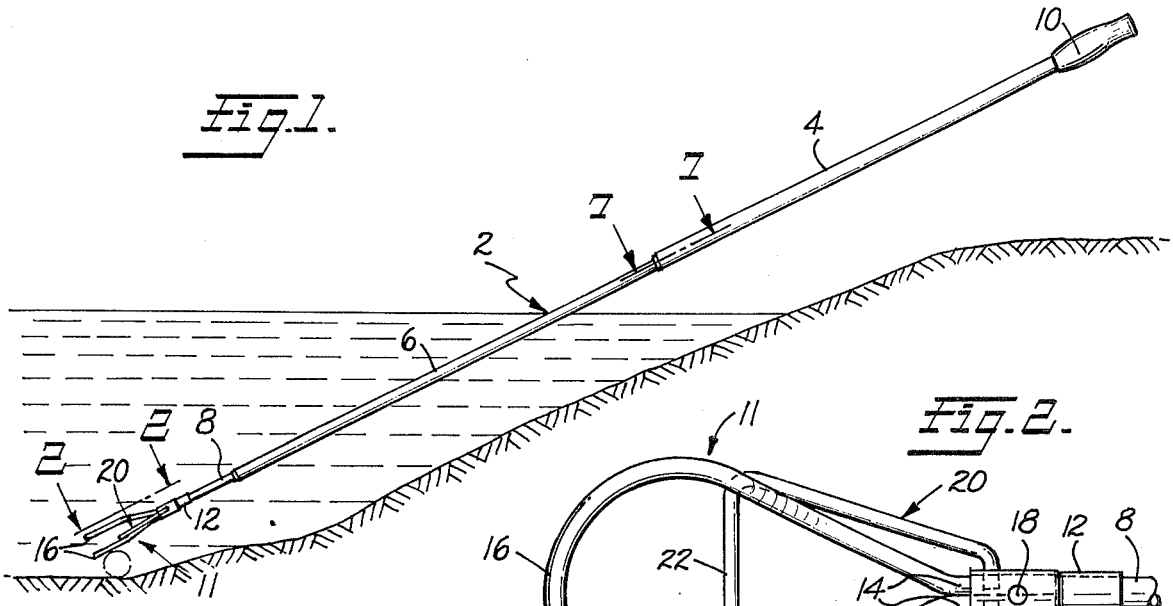
FIG. 1 is a view indicating the manner of use of the present invention.

The ball retriever shown in FIG. 1 comprises generally a telescopically extensible handle 2 having a ball retriever portion 11 at one end thereof. The handle 2 comprises telescopically nested sections 4, 6 and 8 so that the handle may be collapsed to a convenient length or extended to generally three times that length for reaching golf balls in relatively inaccessible positions. The handle portion is also provided with a hand grip 10 at the end thereof remote from the retriever portion 11.

Figure 2:
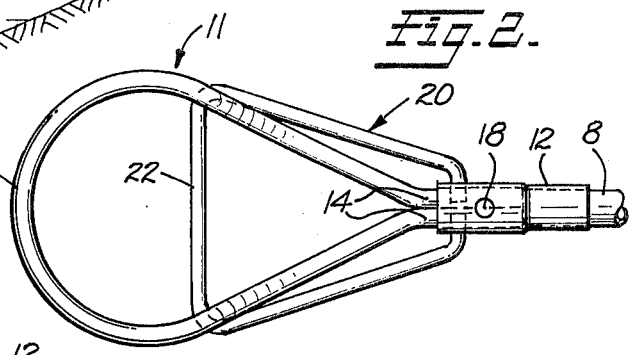
FIG. 2 is a fragmentary plan view of a portion of the device shown in FIG. 1 as seen from 2—2.
Figure 3:
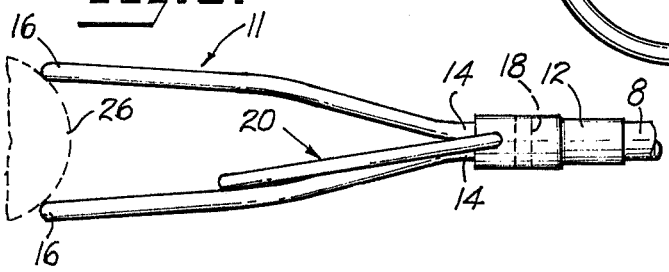
FIG. 3 is a side view of the structure of FIG. 2.

As shown in greater detail in FIGS. 2 and 3, one end of the handle section 8 is provided with a ferrule device 12 fixed thereto and providing a socket receiving the ends 14 of a pair of generally tear-shaped wire loops 16. Each of the loops 16 is configured preferably as shown in the drawings with its ends 14 extending into the ferrule 12 and being locked therein by a rivet 18 or the like. As is best shown in FIG. 3, the loops 16 diverge from the ends 14 so that at their outer ends they are spaced apart a distance somewhat less than the diameter of a golf ball. The loops 16 are of such size that a golf ball will pass freely through the area circumscribed by each loop.

Pivotally mounted on the ferrule 12 is a generally U-shaped gate element 20 likewise preferably formed of bent wire having gating portion 22 extending across the openings of the loops 16 but being between the loops and pivoted to the ferrule 12 on an axis whereby the gate member 20 may swing to but not through each of the loops 16. As is clearly evident from FIG. 2, the gating portion 22 of the gate 20 serves to block the opening through one loop or the other, in a manner to be described.

As an alternative, a hollow rivet could be employed instead of the solid rivet 18 and so positioned as to serve as a pivot for the gate 20.

Figure 4:
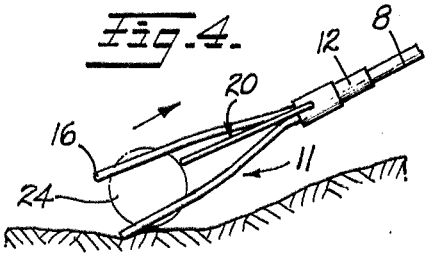
FIGS. 4, 5 and 6 are sketches indicating the sequence of manipulations in retrieving and releasing a golf ball.
Figure 5:
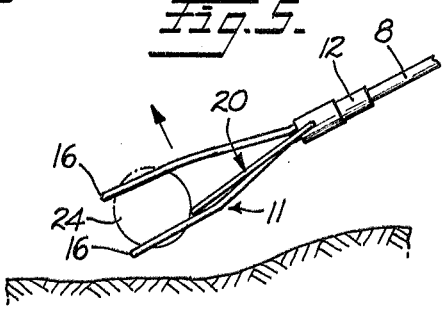
Figure 6:
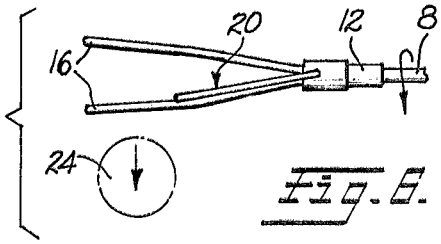

FIGS. 4, 5 and 6 illustrate a sequence of manipulation whereby a golf ball may be retrieved and released. Numeral 24 indicates a golf ball to be retrieved and as shown, the device may be positioned so that the loops 16 overlie the ball with either selected one of the loops uppermost. The device is then lowered over the golf ball to the position shown in FIG. 4, the ball passing freely through the lower loop and lifting gate 20 as indicated in the figure. Additional movement, such as by drawing or "raking" the retriever rearwardly will cause the golf ball to move forwardly relative to the loops a slight amount sufficient to permit the gate 20 to drop past the diameter of the ball 24 to the position generally shown in FIG. 5. In this position, the retriever may be lifted as indicated by the arrow but the ball 24 cannot drop outwardly through the bottom loop 16 since the gate 20 blocks the opening through that bottom loop and the ball may be lifted free of the water or other hazard from which it is retrieved. When the retriever with the ball 24 thereon has been withdrawn to a safe or desired position, it is only necessary to invert the retriever, as indicated by the arrow in FIG. 6, in which case the ball drops freely through the other loop 16 of the retriever as clearly indicated in FIG. 6. This permits recovery of a golf ball without the necessity of handling or manipulating a wet or muddy retriever structure or ball. It is to be noted that after the ball has been captured, as in FIG. 5, no particular care need be exercised in lifting it from the hazard since the ball is securely trapped until the device is completely inverted as described.

The wire loops 16 are preferably somewhat resiliently flexible so that they may be sprung apart slightly without exceeding their elastic limits. Since they are spaced apart an amount only slightly less than the diameter of a golf ball, it is possible to position the retriever with the ends of the loop 16 against a golf ball, as suggested at 26 in FIG. 3. In some cases the ball 26 may be resting against some heavy or immovable obstruction such as a rock, in which case the retriever may be pushed forwardly sufficiently to cause the loops 16 to spring apart slightly to pass over the golf ball to retrieve the same in that manner. When the ball is within the loops, it is prevented from dropping through the lower loop by gate 20 and is in the position of FIG. 5. In some instances, golf balls become lodged in locations where there is insufficient room above them to manipulate the retriever in the manner previously described, in which case the method of use just described may be employed.

When it is desired to retrieve a golf ball in the manner last described, it is essential that the handle structure 2 be retained in its extended position without collapsing as the retriever is forced endwise over a golf ball. It is also desirable that the entire device be made as light as possible.

Figure 8:
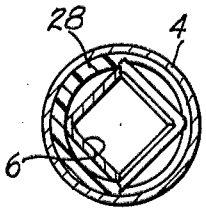
FIG. 8 is a transverse sectional view taken on the line 8—8 of FIG. 7.
Figure 7:
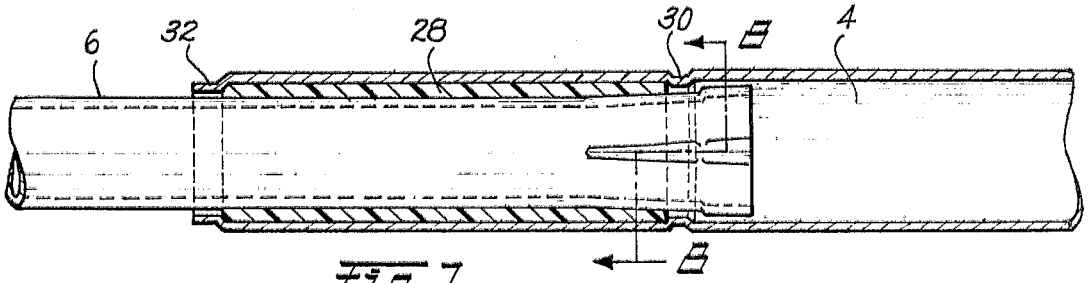
FIG. 7 is a fragmentary longitudinal sectional view taken along the line 7—7 of FIG. 1.

As shown in FIGS. 7 and 8, the tubular sections 4, 6 and 8, by way of example, are preferably made of aluminum which would gall if rubbed together a substantial number of times in extending and collapsing the handle. To prevent such galling one end of outer tubular member 4 (and the other end of member 6) is provided with a resilient plastic sleeve 28 held therein by rib 30 and reduced end portion 32. The sleeve 28 provides a non-galling frictional guide for the inner tubular member slidable therein. The inner end portion of tubular member 6, which is of generally circular cross section, is deformed to substantially the square shape indicated in FIG. 8. The corners of the square gradually taper inwardly so that the inner tubular member 6 may be forcibly pulled to fully extended position, as shown in FIG. 7, wherein the corner portions of the squared shape press into the resilient sleeve 28 and provide a tight frictional holding arrangement to prevent collapse of the handle when used to retrieve a golf ball in the manner last described.

While a single specific embodiment of the invention has been shown and described herein, the same is merely illustrative of the principles of the invention and other forms may be resorted to within the scope of the appended claims.

I claim:

1. In a golf ball retriever having an elongated handle, a ball retainer secured to said handle, an opening in one side of said retainer large enough to pass a golf ball therethrough and a pivoted gate within said retainer freely swingable to but not through said opening to hold a golf ball in said retainer and swingable away from said opening to admit a golf ball therethrough and past said gate, the improvement comprising:

said retainer being in the form of two spaced loops lying in planes generally parallel to the axis of said handle and extending from one end thereof, said gate being pivoted to said handle between said loops and swingable to but not through either of said loops whereby a golf ball may enter said retriever through either one of said loops and be discharged therefrom through the other loop by merely inverting said retainer.

2. A golf ball retriever as defined in claim 1 wherein said loops are resilient and spaced apart a distance less than the diameter of a golf ball whereby they may be flexed apart by forcing a golf ball between the outer ends thereof into said retainer.

3. A golf ball retainer as defined in claim 1 wherein said gate is in the form of a generally U-shaped bail member pivoted adjacent said end of said handle and the bight portion of which extends between said loops and across said openings.

4. A golf ball retriever as defined in claim 3 wherein said loops are of generally tear-drop shape the narrow ends of which are secured to said handle, said bight portion of said gate extending across said loops and the legs of said gate being pivoted to said handle adjacent said narrow ends of said loops.

5. A golf ball retriever as defined in claim 4 wherein the pivot axis for said gate is substantially midway between the planes defined by said openings.

* * * * *